United States Patent [19]

Reimer

[11] Patent Number: 4,597,618

[45] **Date of Patent: * Jul. 1, 1986**

[54] STABILIZED ARRAY PIN CONNECTOR

[75] Inventor: William A. Reimer, Wheaton, Ill.

[73] Assignee: GTE Automatic Electric Inc., Northlake, Ill.

[ * ] Notice: The portion of the term of this patent subsequent to Jul. 23, 2002 has been disclaimed.

[21] Appl. No.: 562,636

[22] Filed: Dec. 19, 1983

[51] Int. Cl.[4] ..... H01R 13/621

[52] U.S. Cl. ..... 339/65; 339/92 M; 339/176 M

[58] Field of Search ..... 339/75 M, 176 M, 184 R, 339/184 M, 186 R, 186 M, 217 R, 221 R, 221 M, 75 R, 92 R, 92 M, 198 R, 65, 66 R, 66 M

[56] References Cited

U.S. PATENT DOCUMENTS

| | | | |
|---|---|---|---|
| 2,031,914 | 2/1936 | Veysey et al. | 339/92 R |
| 3,740,697 | 6/1973 | Van Son | 339/156 R |
| 3,750,086 | 7/1973 | Iversen | 339/75 M |
| 4,054,347 | 10/1977 | Mouissie | 339/75 M |
| 4,076,362 | 2/1978 | Ichimura | 339/75 MP |
| 4,266,840 | 5/1981 | Seidler | 339/75 M |
| 4,483,577 | 11/1984 | Novis | 339/176 M |

FOREIGN PATENT DOCUMENTS

| | | | |
|---|---|---|---|
| 2655216 | 6/1978 | Fed. Rep. of Germany | 339/75 M |

OTHER PUBLICATIONS

"Wedge-Activated Low Insertion Force Connector", *IBM Bulletin*, vol. 11, No. 11, Apr. 1969.

*Primary Examiner*—Gil Weidenfeld
*Assistant Examiner*—Gary F. Paumen
*Attorney, Agent, or Firm*—Robert J. Black

[57] ABSTRACT

A connector having a base including a lower surface and a plurality of apertures. The apertures each engage a corresponding one of a quantity of terminating pins. A lock member is provided within a channel formed in the base to engage and lock engaged pins between the lock member and an aperture side wall. The combination of locking centrally located pins via the lock member and preventing over engagement of outwardly positioned pins by action of the pins on end walls of corresponding apertures acting to stabilize the connector relative to the pins.

1 Claim, 4 Drawing Figures

STABILIZED ARRAY PIN CONNECTOR

CROSS-REFERENCES TO RELATED APPLICATIONS

Related, commonly assigned, co-pending applications include "Connector Lock Arrangement," issued July 23, 1985 as U.S. Pat. No. 4,530,558, Ser. No. 562,637; "Connector Wiring Channel," now abandoned, Ser. No. 562,874; "Connector Aligning Arrangement," now abandoned, Ser. No. 562,634; and "Engagement Limiting Connector," now abandoned, Ser. No. 562,635, all filed concurrently herewith and invented by the same inventor.

BACKGROUND OF THE INVENTION (1) Technical Field

The present invention relates to connectors and more particularly, to connectors that include arrangements for locking a connector to an array of pins, for routing cable conductors to connector contacts, for aligning a pin array connector with associated pins, for limiting engagement of the connector on an array of pins, and for stabilizing a connector connected to an array of pins.

(2) Background Art

Connectors are very well known to those skilled in the art. One type, described in U.S. Pat. No. 3,740,697, issued June 19, 1973, to Darryl J. Van Son includes a base portion with vertically disposed walls extending therefrom. The walls form a receptacle cavity and the base forms a plug which is proportioned such that it may be inserted into the receptacle cavity of another connector. The base includes a plurality of pin receiving apertures into which connector pins are disposed. A portion of each of the pins extends into the cavity to permit connection to electrical wiring and to another connector which may be plugged into the cavity.

Another type of connector is described in U.S. Pat. No. 3,750,086, issued July 31, 1973, to Ralph T. Iversen, and includes an insulated body having a plurality of wire receiving pins on one side thereof to which wire ends of a multiconductor cable are connected and a plurality of terminal pin receiving openings on the other side. The cable pins extend into the body and terminate in spring fingers adjacent to the terminal pin receiving openings. The spring fingers are formed to leave the openings free of obstruction in their normal position to permit a large number of pins to be simultaneously received within the openings with a minimum of friction. Cam means are provided to simultaneously reposition groups of spring fingers into engagement with the pins positioned within the pin openings.

Yet another type of connector is-described in U.S. Pat. No. 4,066,318, issued Jan. 3, 1978, to David L. Vonder. This patent relates to a stackable electrical connector including an enclosure having a floor and a divider wall defining first and second aligned partial enclosures. Each partial enclosure includes a plurality of apertures extending through the floor which are arranged in a predetermined array with a wire connecting pin in each aperture including a wire terminating portion extending above the floor and a receptacle portion terminating within the floor. A block portion is provided adjacent each partial enclosure and includes an alignment key and a cable clamp for securing a cable to each block. Each wire connecting pin has a plug portion extending above the wire terminating portion to engage wire connecting pins positioned within apertures of an above stacked connector.

Still another connector is described in U.S. Pat. No. 4,232,924, issued Nov. 11, 1980, to Mark H. Kline, et al. This patent includes a connector body including a plurality of pin receiving apertures formed therethrough and a connector pin including a contact portion positioned within each of the apertures. The apertures and the pin contact portion are arranged to engage contact pins extending from a circuit card backplane. The connector pins extend outward from the back surface of the connector and are connected to another circuit card.

The above arrangements while operating generally satisfactorily include characteristics which have been found to be disadvantageous. For example, none of the cited arrangements include means to lock the connector on the engaged pins. Such connectors have been found to disengage or walk off their engaged connectors in the presence of vibration and shock.

Most of the cited connectors include means for terminating cable conductors to respective ones of the connector's contact pins which are positioned in an array within the connector body. Such an arrangement has been found to promote congestion around the pins thus making maintenance and retermination to the pins difficult.

In the Van Son and Vonder patents the arrangements shown require the formation of an alignment wall at least partly surrounding the connected pins. This requirement increases the cost and complexity of the terminations thus provided. On the other hand, the Iversen and Kline patents do not provide alignment means other than the connected pins themselves. This arrangement, while simple and economical requires accurate alignment of the connector with the pins before engagement can occur.

It is also well known by those skilled in the art that engagement of the connector upon engaged pins must be controlled to prevent damage to the engaged pins, to wires terminated thereto, and to the pin engaging contacts of the connector itself. The Van Son and Vonder patents accomplish this control by means of a wall of controlled height at least partly surrounding the engaged pins. This method of engagement control increases the cost and complexity of the connections thus provided. On the other hand, the Iversen and Kline patents permit the connector to bottom on the body from which the pins extend. Such an arrangement does not allow for pins of varying heights nor space for wire terminations.

Finally, the Van Son and Vonder patents, while utilizing a wall surrounding the connected pins to prevent lateral motion of the connector relative to the pins, are susceptible to forces in the direction of the engaged pins tending to disengage the connector from the pins. The Iversen and Kline patents on the other hand, include the same disadvantages as the Van Son and Vonder patents and additionally are not protected from forces tending to bend the engaged pins or rock the connector out of engagement with the pins.

SUMMARY OF THE INVENTION

The present invention provides a connector arranged to establish electrical connection with and lock onto at least a portion of a plurality of terminating pins and includes a base of rigid electrically insulating material including a lower surface and an upper surface.

A plurality of apertures are formed in the base lower surface and are arranged to engage the terminating pins, each aperture including a side wall.

The connector also includes a connector pin including a contact portion, the contact portion positioned within each of the apertures, the contact portion engaging and establishing electrical connection with corresponding ones of the terminating pins and at least one channel formed in the base lower surface.

A lock member positioned within the channel and an actuator is provided and operated to deflect the lock member towards the aperture side wall and lock the terminating pin therebetween.

Also provided is an arrangement for routing wires to contact pins of a connector from an attached cable.

The arrangement includes the above mentioned connector pins arranged in an array in the base, each pin including a wire terminating portion extending from the base upper surface and a pair of walls, each wall located adjacent to and outward of the pin terminating portions and spaced inward from a respective one of the side surfaces on the base, the walls each including an upper edge.

A ledge extends horizontally outward from the upper edge of each wall toward and terminating in an edge parallel to a plane including a respective one of the base side edges, the ledge, the corresponding wall, and the base upper surface defining a wire routing channel above and within the outer dimensions of the base. A wiring access slot is formed in each of the walls, the slot providing access to predetermined ones of the connector pin wire terminating portions from the respective wiring channel.

The connector is aligned with a plurality of terminating pins prior to engagement of the connector therewith and includes a plurality of pin alignment slots formed in the base lower surface. The slots are formed parallel to each other, each slot coincident with at least one of the apertures, the connector base initially positioned to engage the slots with corresponding terminating pins, subsequently positioned to relocate the terminating pins along the alignment slots and align the pins with the apertures, and finally positioned to engage the terminating pins within the corresponding apertures.

In the connector, engagement to the plurality of the terminating pins is limited. Connector pins including a contact portion are positioned within some of the apertures, the connector pin contact portion engaging a side surface of a corresponding terminating pin.

A plurality of other apertures are formed in the base lower surface, include an upper end, and are positioned to engage a corresponding terminating pin, the other aperture upper ends abutting corresponding ones of the upper ends of the pins, permitting the connector pin contact portions to engage the terminating pins along their sides while preventing the terminating pin upper ends from contacting the connector pins.

Additionally, the combination of elements noted above inhibits movement between the backplane and the connector of the present invention.

BRIEF DESCRIPTION OF THE DRAWING

Various features and advantages of the connector arrangement of the present invention will be apparent from the following description taken in conjunction with the accompanying drawing in which.

DESCRIPTION OF THE PREFERRED EMBODIMENT

Figure 1:
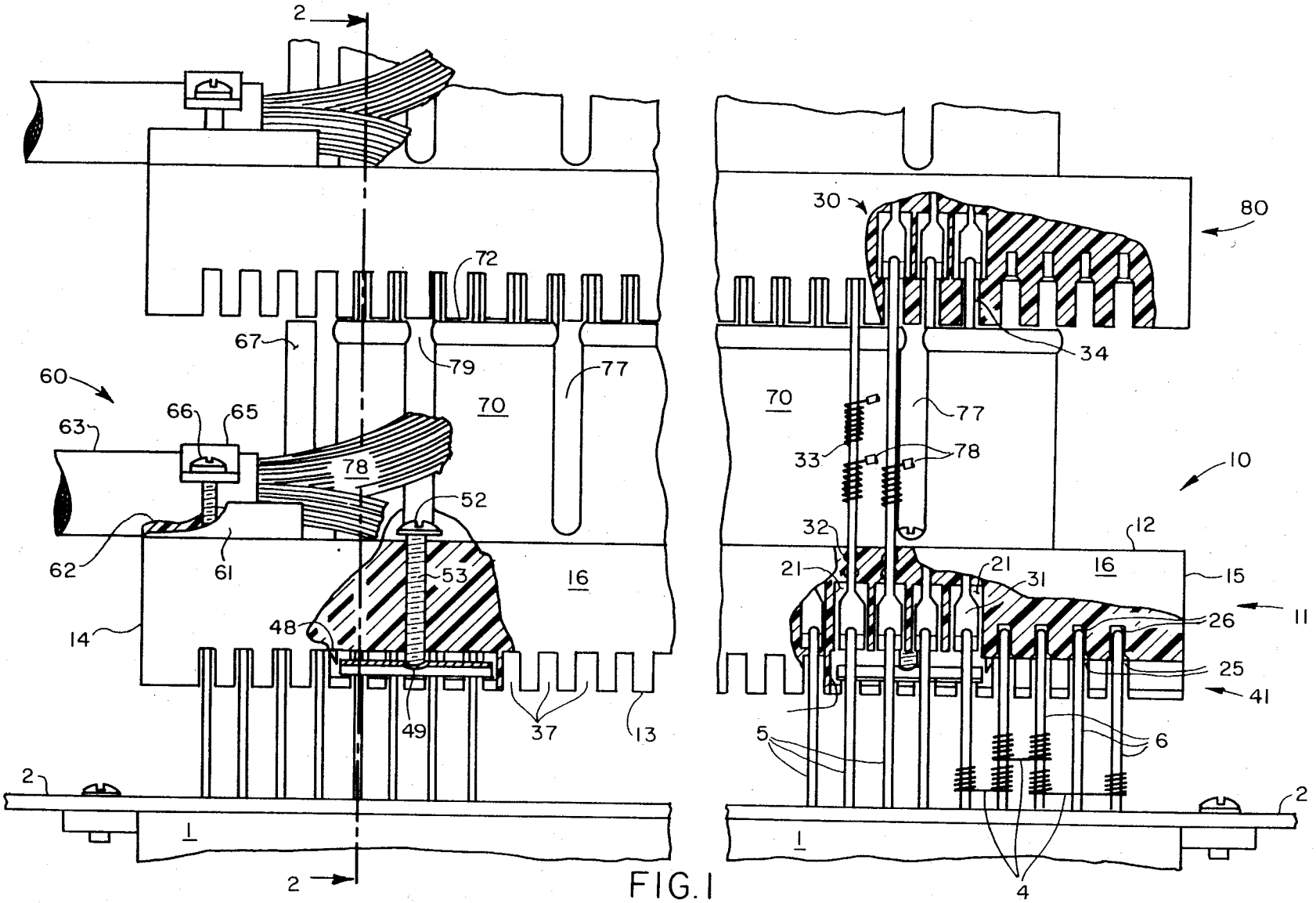
FIG. 1 is a side view of the connector of the present invention showing its ability to stack upon itself and to stack upon an array of backplane pins.

Referring first to FIG. 1, there is shown a first connector 1 rigidly attached to a system backplane 2 or a similar mounting element, the connector 1 having an array of terminating pins 3 rigidly extending from the connector 1 and protruding through the backplane 2. The terminating pins 3 are resistant to deformation in directions both perpendicular and parallel to themselves and extend upward from the backplane to a distance great enough to permit their interconnection by a plurality of circuit wires 4. A second connector 10 is provided including a base 11 having an upper surface 12, a lower surface 13, a front end 14, a rear end 15, a right side surface 16, and a left side surface 17 (both side surfaces are shown in FIG. 2).

The terminating pins 3 include a plurality of contact terminating pins 5 centrally located on each of the system connectors 1 surrounded by a plurality of positioning pins 6 also part of each of the system connectors 1.

Figure 2:
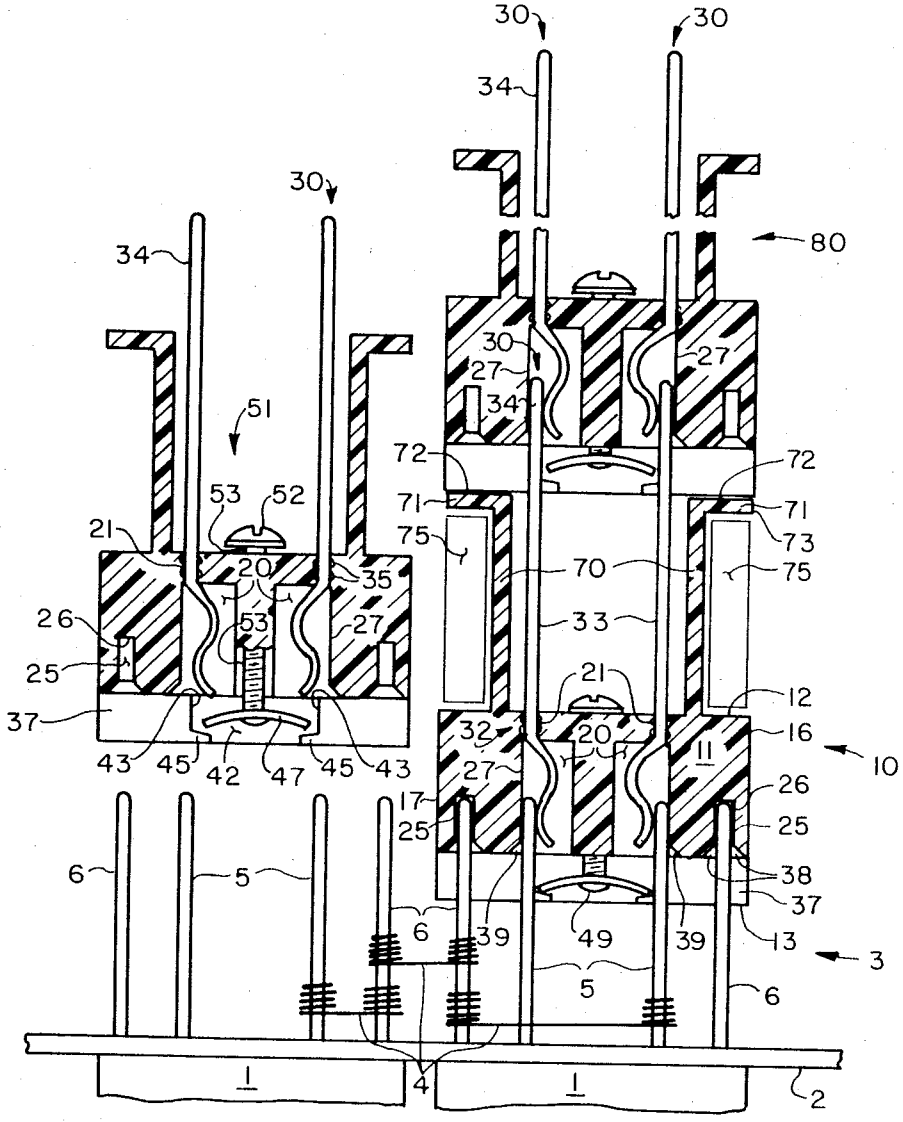
FIG. 2 is a cross-sectional view of the connector of the present invention taken along line 2—2 in FIG. 1.

Referring now to FIG. 2, the connector base 11 includes a plurality of contact pin apertures 20 formed in the base lower surface 13 and extending upward a predetermined distance. A neck portion 21 extends upward from each of the contact pin apertures 20 to the base upper surface 12. The connector base 11 also includes a plurality of positioning pin apertures 25 extending upward from the base lower surface 13 a predetermined distance and ending in a blocked upper end or ceiling 26. A contact pin 30 including a contact portion 31, a retaining portion 32, a wire terminating portion 33, and a plug portion 34 is positioned within each of the contact pin apertures 20. Each of the contact pins 30 is retained in its position by a plurality of dimples 35 formed on each contact retaining portion 32 surface rigidly engaging the respective contact pin aperture neck portion 21. The contact portions 31 of the connector pins 30 are biased to resiliently engage the pins 5 of the system connector 1.

Referring again to FIG. 1, a plurality of alignment slots 37 are formed in the base lower surface 13 and intersect a pair of the contact pin apertures 20 and also a pair of the positioning pin apertures 25 in the central portion of the connector 10. The aligning slots 37, on the other hand, may engage four of the positioning pin apertures 25 and none of the contact pin apertures 20 in the vicinity of the connector base front end surface 14 or the connector base rear end surface 15.

Figure 3:
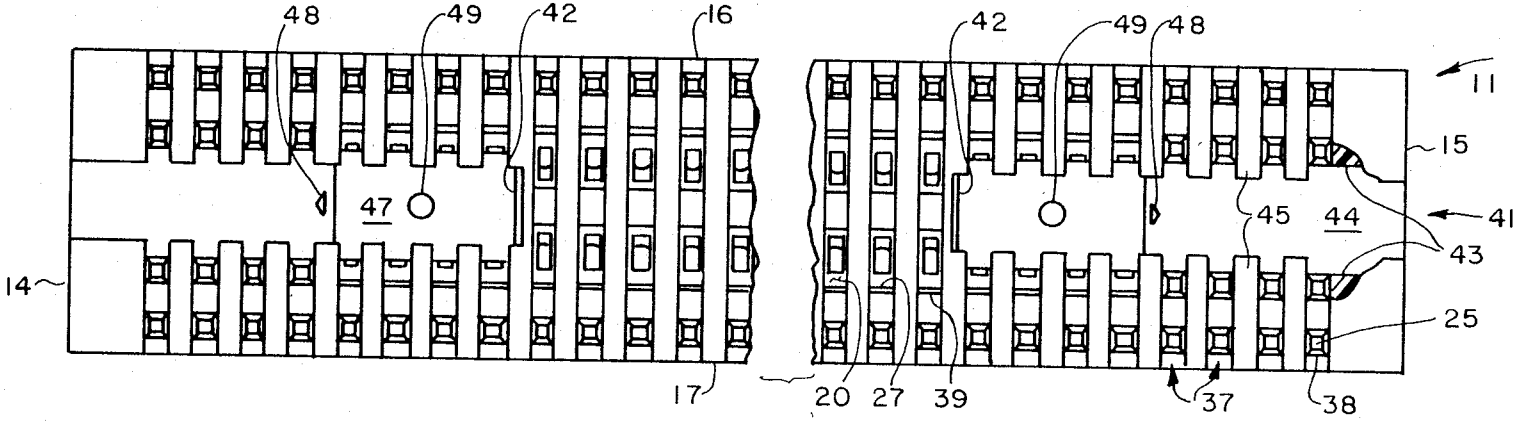
FIG. 3 is a bottom view of the connector of the present invention.

Referring now to FIG. 3, each of the positioning pin apertures 25 includes a beveled mouth 38 at the junction between the aperture 25 and each of the aligning slots 37. Each of the contact pin apertures 20 includes a beveled lip 39 on an outward side of the aperture.

Each of the contact pin apertures 20 further includes a contact pin engaging side wall 27. A channel 41 is formed in the base lower surface 13 extending inward from the base front end 14 and the base rear end 15 and each terminates in a wall 42 (also shown in FIG. 2). The channel 41 may alternately extend from base front end 14 to base rear end 15. The channel 41 also includes a pair of side walls 43 and a ceiling 44. A pair of fingers 45 extend inward from the walls 43 of the channel 41 in the plane of the base lower surface 13, a predetermined distance between each pair of the alignment slots 37. A lock member 47 is positioned within the channel 41 and rests on the channel fingers 45 and against the channel ceiling 44 (see FIG. 2). The lock member 47 is of insulating material and arcuate in cross-section. Retainers 48 are formed protruding downward from the channel ceiling 44 to prevent the lock member 47 from sliding out of the channel 41 in a direction toward the base front end 14 or the base rear end 15, this when the lock member 47 is in its unactuated position. Lock member 47 further includes an actuator receiving depression 49 formed centrally therein.

Referring to FIG. 2 again, an actuator 51 is positioned through the base 11 from the base upper surface 12 to the lock channel ceiling 44 and is located to permit the fastener 51 to engage the lock member recess 49 when the actuator 51 is actuated. The actuator 51 includes a head portion 52 and a body portion 53 as shown in FIG. 1.

Referring to FIG. 1 there is also shown a cable clamp 60 including a clamp base 61 attached to the connector base upper surface 12 and including a cable receiving channel 62 formed to closely conform to the outer surface of an attached cable 63.

Figure 4:
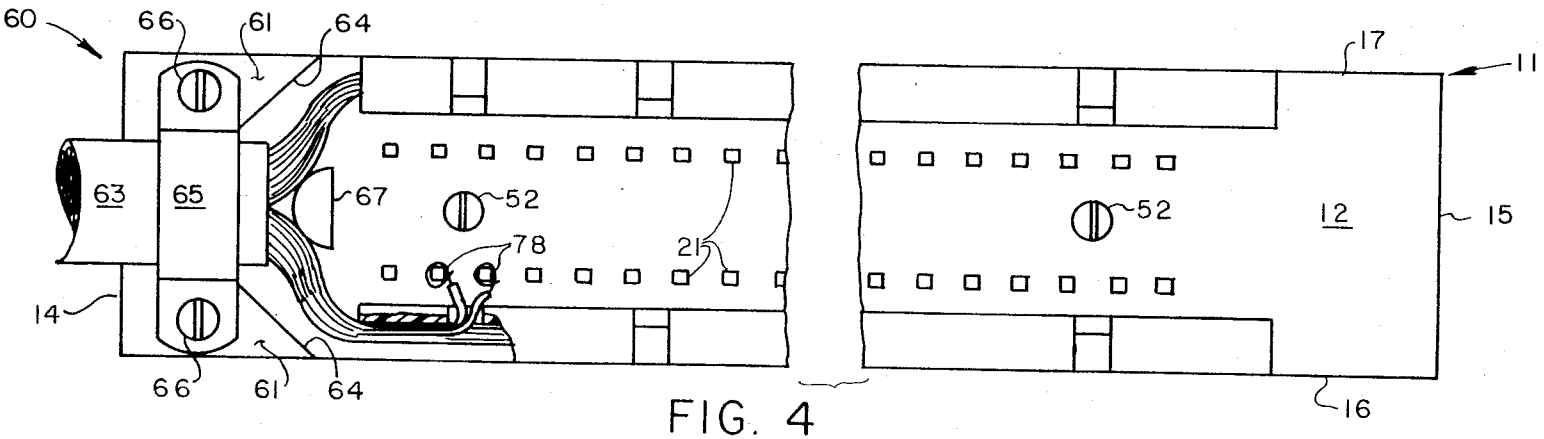
FIG. 4 is a top view of the connector of the present invention.

Referring now to FIG. 4, the clamp base 61 includes a pair of wire guide surfaces 64 extending from the cable receiving channel 62 in a divergent direction toward the connector base rear end 15 and terminating at a respective one of the connector base side surfaces 16 or 17. The cable clamp 60 additionally includes a cable retaining strap 65 and a pair of fasteners 66. The cable 63 is positioned in the cable receiving channel 62 of the base 61 and under the cable retaining strap 65 which is held in relation to the clamp base 61 by the fasteners 66 to retain the cable 63 therebetween. A wiring guidepost 67 is included extending vertically upward from the base upper surface 12 in line with the center of the cable 63.

Referring to FIG. 1, a pair of walls 70 extend upward from the base upper surface 12 adjacent to the connector pin terminating portions 33 and spaced inward from a respective one of the base side surfaces 16 and 17. The walls extend a predetermined height greater than that of the connector pin terminating portion 33 but less than that of the connector pin plug portion 34 thus leaving the plug portion exposed above each of the walls 70, each of which includes an upper edge 72.

Referring now to FIG. 2, a ledge 71 extends horizontally outward from an upper edge 72 of the walls 70 toward and terminating in an edge 73 parallel to a plane including a respective one of the base side edges 16 or 17. The ledge 71, the wall 70, and the base upper surface 12 defining a wire routing channel 75 shown in phantom line.

Referring now to FIG. 1, each wall 70 includes a plurality of wiring access slots 77 formed at regular intervals therealong to permit conductors 78 of the cable 63 to be routed from the wiring channel 75 to a respective one of the connector pin terminating portions 33. Each of the wiring access slots 77 includes a neck 79 wide enough to permit forcing the cable conductors 78 therethrough, to assist in retaining the conductors 78 within the slots 77.

Referring now to FIG. 2, connector 10 is engaged with backplane pins 3 by positioning the pin alignment slots 37 into engagement with the backplane pins 3. The connector is then slid in the direction of the alignment slots 37 until the contact pins 5 align with the contact pin apertures 20 and the positioning pins 6 align with the positioning pin apertures 25. The beveled mouths 38 of the positioning pin apertures 25 and the beveled lips 39 of the contact pin apertures 20 assist in the alignment of the contact pins 5 and the positioning pins 6 with their corresponding apertures. Force is then applied to the connector 10 to engage the backplane pins 3 within their respective apertures to the point where positioning pin aperture ceiling 26 contacts the positioning pin 6.

The connector of the present invention is operated to connect a third connector 80 to the connector of the present invention 10 in a manner similar to that described above, however, when engaging the third connector 80 with the connector 10, force is applied to the third connector 80 in a direction to encourage engagement with the connector 10 until the connector base lower surface 13 of the third connector 80 contacts the ledge 71 of the connector 10. It will be appreciated when joining two connectors that the positioning pin apertures are not used.

In either of the two cases above, once the connector has been properly mated with its respective pins, the actuator head 52 of the connector 10 or 80 is rotated to deform the lock member 47 outward in a direction toward the contact pin aperture side walls 27 and to lock the contact pins 5 or the connector pin plug portions 34 therebetween.

It will be appreciated that other variations of the present invention are also possible. For example, either of the connectors 10 or 80 may, in addition, to terminating cable conductors, be used to terminate a printed wiring board or circuit components. When used in this application, it is preferred that the connector 10 or 80 not terminate any additional connectors via its associated contact pin plug portions 34.

It will now be apparent that a connector arrangement has been described hereinabove which offers significant advantages over prior art assemblies. Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. In combination:

means supporting a plurality of rigid terminating pins, each extending in the same direction from said supporting means and each including an upper end, said terminating pins including a group of contact terminating pins surrounded by a group of positioning terminating pins; and a connector comprising:

a base having a lower surface, an upper surface, at least two opposite ends and at least two opposite side surfaces, a plurality of positioning pins apertures formed in said base lower surface adjacent to each of said base sides and ends, said positioning pin apertures each engaging a corresponding one of said positioning terminating pins and each including a blocked upper end, said upper ends of said positioning terminating pins each in contact with a corresponding one of said positioning pin aperture blocked upper ends, a plurality of contact pin apertures each extending between said base lower and upper surfaces, surrounded by said positioning pin apertures and each engaged with a corresponding one of said contact terminating pins, at least one channel formed in said base lower surface and at least partly intersecting at least one of said contact pin apertures, said channel extending from an end of said base inward and terminating in a wall, an electrically nonconductive lock member positioned within said channel, said lock member operated to lock said engaged contact terminating pin within said intersected contact pin aperture, said positioning pin aperture blocked upper ends cooperating with said positioning terminating pins engaged therewith and said locked contact terminating pin to inhibit movement between said supporting means and said connector.

* * * * *